US008956118B2

(12) United States Patent
Wakai et al.

(10) Patent No.: US 8,956,118 B2
(45) Date of Patent: Feb. 17, 2015

(54) IMPELLER OF CENTRIFUGAL COMPRESSOR

(75) Inventors: Tokiya Wakai, Tokyo (JP); Akihiro Nakaniwa, Tokyo (JP); Yasuro Sakamoto, Tokyo (JP); Takashi Hiyama, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 584 days.

(21) Appl. No.: 13/386,993

(22) PCT Filed: Feb. 19, 2010

(86) PCT No.: PCT/JP2010/001091
§ 371 (c)(1),
(2), (4) Date: Jan. 25, 2012

(87) PCT Pub. No.: WO2011/013258
PCT Pub. Date: Feb. 3, 2011

(65) Prior Publication Data

US 2012/0121432 A1 May 17, 2012

(30) Foreign Application Priority Data

Jul. 29, 2009 (JP) ..... 2009-176609

(51) Int. Cl.
*F04D 29/28* (2006.01)
*F04D 29/30* (2006.01)

(52) U.S. Cl.
CPC ..... *F04D 29/284* (2013.01); *F04D 29/30* (2013.01)
USPC ..... 416/183; 416/223 B

(58) Field of Classification Search
CPC ..... F04D 29/284
USPC ..... 416/179, 182, 183, 185, 188, 223 A, 416/223 B
See application file for complete search history.

(56) References Cited

U.S. PATENT DOCUMENTS 2,965,287 A * 12/1960 Schug ..... 416/188
4,790,720 A * 12/1988 Rodgers ..... 415/208.3

FOREIGN PATENT DOCUMENTS

CN 101012838 8/2007
EP 1 887 227 2/2008

(Continued)

OTHER PUBLICATIONS

Chinese Office Action issued Dec. 25, 2013 in corresponding Chinese Patent Application No. 201080032319.2 with English Translation.

(Continued)

*Primary Examiner* — Nathaniel Wiehe
*Assistant Examiner* — Kayla McCaffrey
(74) *Attorney, Agent, or Firm* — Wenderoth, Lind & Ponack, L.L.P.

(57) ABSTRACT

Provided is an impeller of a centrifugal compressor including: a hub; a plurality of blades protruding from a surface of the hub, wherein a passage is formed by the hub and a blade being adjacent with the hub, so that a fluid, flowing in along an axial direction at an inner circumferential side in a radial direction, is flowed out toward an outer circumferential side in a radial direction; each of the plurality of blades includes a main body part and a leading edge, the main body part including a pressure side and a suction side; an angle between a component central line of the main body part and the axial direction increases from an inner end toward an outer end; and a radius of curvature at a central position, intersecting with the component central line of the leading edge, decreases from the inner end toward the outer end.

7 Claims, 7 Drawing Sheets

(56) References Cited

FOREIGN PATENT DOCUMENTS

| | | |
|---|---|---|
| FR | 2 282 058 | 3/1976 |
| JP | 2000-45997 | 2/2000 |
| JP | 2004-044473 | 2/2004 |
| JP | 3693121 | 9/2005 |
| JP | 3702105 | 10/2005 |
| WO | 99/36701 | 7/1999 |
| WO | 2006/126408 | 11/2006 |

OTHER PUBLICATIONS

Japanese Notice of Reasons for Rejection mailed Oct. 1, 2013 in corresponding Japanese Application No. 2009-176609 with English translation.

International Search Report issued Mar. 23, 2010 in International (PCT) Application No. PCT/JP2010/001091.

Written Opinion of the International Searching Authority issued Mar. 23, 2010 in International (PCT) Application No. PCT/JP2010/001091 with English translation.

* cited by examiner

IMPELLER OF CENTRIFUGAL COMPRESSOR

TECHNICAL FIELD

The present invention relates to a centrifugal compressor which provides energy to a fluid by a rotation of an impeller.

The present invention claims priority from Japanese Patent Application No. 2009-176609, filed Jul. 29, 2009, the contents of which are incorporated herein by reference.

BACKGROUND ART

A centrifugal compressor is a type of a turbo compressor. Such a centrifugal compressor is used at petrochemical plants, natural gas plants, and the like. The centrifugal compressor compresses natural gas and gas obtained by crude oil degradation. The centrifugal compressor sends this compressed gas to a pipeline and a reaction process of various plants. Such a centrifugal compressor includes a hub fixed to a main axis, and an impeller having a plurality of blades. Pressure energy and velocity energy are provided to gas by the centrifugal compressor rotating the impeller.

For example, Patent Document 1, listed below, discloses an impeller which has a plurality of main blades provided at equal intervals around a main axis. Seen from a planar view from a direction of the main axis, a leading edge of a main blade of the impeller is curved in a bow-shape in a direction opposite to a direction of rotation. Furthermore, a first angle formed by a line in a radial direction and a tangential line at a blade edge of the leading edge is greater than or equal to 10 degrees.

According to such a configuration, it is possible to prevent low-energy fluid from accumulating at a suction side of the main blade. By reducing an internal loss in this way, the compression efficiency increases.

PRIOR ART DOCUMENT

Patent Document

[Patent Document 1] Japanese Unexamined Patent Application, First Publication No. 2004-44473

DISCLOSURE OF INVENTION

Problems to be Solved by the Invention

However, in recent years, there has been a greater demand to further heighten the pressure ratio and to enlarge the capacity of a centrifugal compressor. There is a problem in that conventional technology cannot adequately respond to such a demand.

The present invention is made in light of the considerations described above. An object of the present invention is to provide a highly efficient centrifugal compressor.

Means for Solving the Problems

In order to solve the problems described above the following configurations are made.

In other words, an impeller of a centrifugal compressor according to an aspect of the present invention includes a hub shaped like a disk; a plurality of blades protruding from a surface of the hub and provided radially. Here, a passage is formed by the hub and a blade being adjacent with the hub, so that a fluid, flowing in along an axial direction at an inner circumferential side in a radial direction, is flowed out toward an outer circumferential side in a radial direction. Each of the plurality of blades includes a main body part and a leading edge. The main body part includes a pressure side and a suction side, the pressure side receiving a pressure from a fluid flowing through the passage which is relatively high, the suction side receiving a pressure from a fluid flowing through the passage which is relatively low. The leading edge is shaped as a curved surface connecting the pressure side and the suction side at the inner circumferential side in the radial direction. An angle between a component central line of the main body part and the axial direction increases from an inner end toward an outer end, the inner end connecting with the hub. A radius of curvature at a central position, intersecting with the component central line of the leading edge, decreases from the inner end toward the outer end.

According to this configuration, an angle between a center line of a component and an axial direction increases from an inner end toward an outer end. In other words, an incidence angle between the center line of the component and a direction of a relative inflow velocity becomes smaller from the inner end toward the outer end. As a result, it is possible to enhance the efficiency by reducing the incidence angle at the outer end side which has a high flow velocity of fluid. Furthermore, the radius of curvature at a central position of the leading edge becomes smaller from the inner end toward the outer end. As a result, at the outer end side having a large flow velocity, it is possible to reduce the shock loss of the fluid at the leading edge relative to the inner end side having a small flow velocity. Consequently, it is possible to generally prevent a decline in the efficiency due to a shock loss. In addition, the efficiency may be enhanced even further. Meanwhile, it is possible to retain a flow amount by increasing the area of the passage by increasing the incidence angle at the inner edge side compared to the outer edge side. The flow velocity is lower at the inner edge side. In this way, it is possible to enhance the efficiency while retaining an overall flow amount.

Incidentally, a relative inflow velocity refers to a relative velocity of a liquid flowing in from an axial direction towards a rotating blade.

In addition, the impeller of the centrifugal compressor may be configured as follows: a radius of curvature at the central position toward the outer end of the leading edge is less than half of a component thickness of the main body part at a position connecting with the leading edge.

According to this configuration, a radius of curvature at a central position at an outer end side having a large flow velocity is set to be less than half of the component thickness of the main body. In other words, this radius of curvature is set to be smaller than a curved surface having a cross section shaped as a half-circular arch. In this way, it is possible to enhance the efficiency while further preventing a shock loss.

In addition, the impeller of the centrifugal compressor may be configured as follows: a radius of curvature, toward the inner end of the leading edge, is less than half of a component thickness of the main body part at a position connecting with the leading edge toward the pressure side compared to the central position, and is greater than half of the component thickness toward the suction side.

According to this configuration, at a leading edge of the inner end side having a low flow velocity, a radius of curvature toward a pressure side compared to the central position is set to be less than half of the component thickness of the main body. As a result, it is possible to reduce the shock loss at an inner end side. In addition, a radius of curvature at a suction side compared to the central position is set to be larger than half of the component thickness of the main body. As a result, even at the inner end side, the efficiency may be enhanced by preventing a loss due to a separation of a liquid flowing along the leading edge toward a suction side.

In addition, the impeller of the centrifugal compressor may be configured as follows: a rate of change of a radius of curvature of the leading edge is constant from the inner end toward the outer end.

According to this configuration, the rate of change of the radius of curvature of the leading edge is constant from the inner end toward the outer end. As a result, a manufacturing may be made easily.

In addition, the impeller of the centrifugal compressor may be configured as follows: a rate of change of a radius of curvature of the leading edge varies from the inner end toward the outer end.

According to this configuration, the rate of change of the radius of curvature of the leading edge differs from the inner end to the outer end. Therefore, it becomes possible to select a most appropriate shape based on the conditions of usage, characteristics, and manufacturing costs.

Incidentally, an impeller of a centrifugal compressor according to an aspect of the present invention includes a hub shaped like a disk; a plurality of blades protruding from a surface of the hub and provided radially. Here, a passage is formed by the hub and a blade being adjacent with the hub, so that a fluid, flowing in along an axial direction at an inner circumferential side in a radial direction, is flowed out toward an outer circumferential side in a radial direction. Each of the plurality of blades includes a main body part and a leading edge. The main body part includes a pressure side and a suction side, the pressure side receiving a pressure from a fluid flowing through the passage which is relatively high, the suction side receiving a pressure from a fluid flowing through the passage which is relatively low. The leading edge is shaped as a curved surface connecting the pressure side and the suction side at the inner circumferential side in the radial direction. An angle between a component central line of the main body part and the axial direction increases from an inner end toward an outer end, the inner end connecting with the hub. A shape of a cross section of the leading edge toward the outer end is an oval. A radius of curvature of a tip of the leading edge decreases from the inner end toward the outer end.

According to this configuration, the shape of a cross section at an outer end side is an oval. Further, the radius of curvature at the tip of the leading edge gradually becomes smaller from the inner end side toward the outer end side. According to this configuration, the radius of curvature at the tip of the leading edge becomes smaller at the outer end side at which the incidence angle is relatively small and it becomes difficult for the flow to separate. Therefore, the shock loss at an outer end side, at which it is less likely for fluid to separate, may be greatly reduced. Furthermore, the shock loss may be reduced at a wide range in the radial direction without increasing the likelihood that a separation of the liquid will occur. In this way, the shock loss is greatly reduced. Thus, a high degree of efficiency may be obtained. Consequently, it is possible to provide a highly efficient centrifugal compressor.

Incidentally, an impeller of a centrifugal compressor according to an aspect of the present invention includes a hub shaped like a disk; a plurality of blades protruding from a surface of the hub and provided radially. Here, a passage is formed by the hub and a blade being adjacent with the hub, so that a fluid, flowing in along an axial direction at an inner circumferential side in a radial direction, is flowed out toward an outer circumferential side in a radial direction. Each of the plurality of blades includes a main body part and a leading edge. The main body part includes a pressure side and a suction side, the pressure side receiving a pressure from a fluid flowing through the passage which is relatively high, the suction side receiving a pressure from a fluid flowing through the passage which is relatively low. The leading edge is shaped as a curved surface connecting the pressure side and the suction side at the inner circumferential side in the radial direction. An angle between a component central line of the main body part and the axial direction increases from an inner end toward an outer end, the inner end connecting with the hub. A shape of a cross section toward the inner end of the leading edge is asymmetrical. Here, a radius of curvature toward the pressure side compared to a tip of the leading edge is smaller than a radius of curvature toward the suction side compared to the tip of the leading edge. In addition, a radius of curvature toward the pressure side increases from the inner end toward the outer end while a radius of curvature toward the suction side decreases.

According to this configuration, a cross section of the leading edge at an inner end side is shaped so that the radius of curvature is smaller at a pressure side compared to a tip of the leading edge. Further, this cross section is shaped to be asymmetrical so that the radius of curvature is larger at a suction side compared to a tip of the leading edge. Since a configuration is made so that the radius of curvature of the pressure side is small at an inner end side, it is possible to reduce the shock loss at an inner end side. Further, since a configuration is made so that the radius of curvature is large at the suction side, it becomes less likely that a separation occurs at an inner end side. As a result, the shock loss at the inner end side is reduced. At the same time, a separation of flow is prevented. Therefore, the shock loss may be reduced without increasing the likelihood that the fluid separates. Thus, a high degree of efficiency may be obtained. In this way, it is possible to provide a highly efficient centrifugal compressor.

BRIEF DESCRIPTION OF THE DRAWINGS

FIG. 3 shows a fluid inflow part 32 at an inner end 41 (hub side) in a radial direction.

FIG. 4 shows a fluid inflow part 32 at an outer end 42 (tip side) in a radial direction.

FIG. 6 shows a fluid inflow part 32 at an inner end 41 (hub side) in a radial direction.

FIG. 7 shows a fluid inflow part 32 at an outer end 42 (tip side) in a radial direction.

FIG. 8 shows a fluid inflow part 32 at an inner end 41 (hub side) in a radial direction.

FIG. 9 shows a fluid inflow part 32 at an outer end 42 (tip side) in a radial direction.

FIG. 10 is a graph showing a relationship between a position of a leading edge tip in a radial direction (horizontal axis) and a radius of curvature (vertical axis).

FIG. 11 is a graph showing a relationship between a position of a leading edge tip in a radial direction (horizontal axis) and a radius of curvature (vertical axis).

EMBODIMENTS FOR CARRYING OUT THE INVENTION

Hereinafter, an embodiment of the present invention is described with reference to the diagrams.

Figure 1:
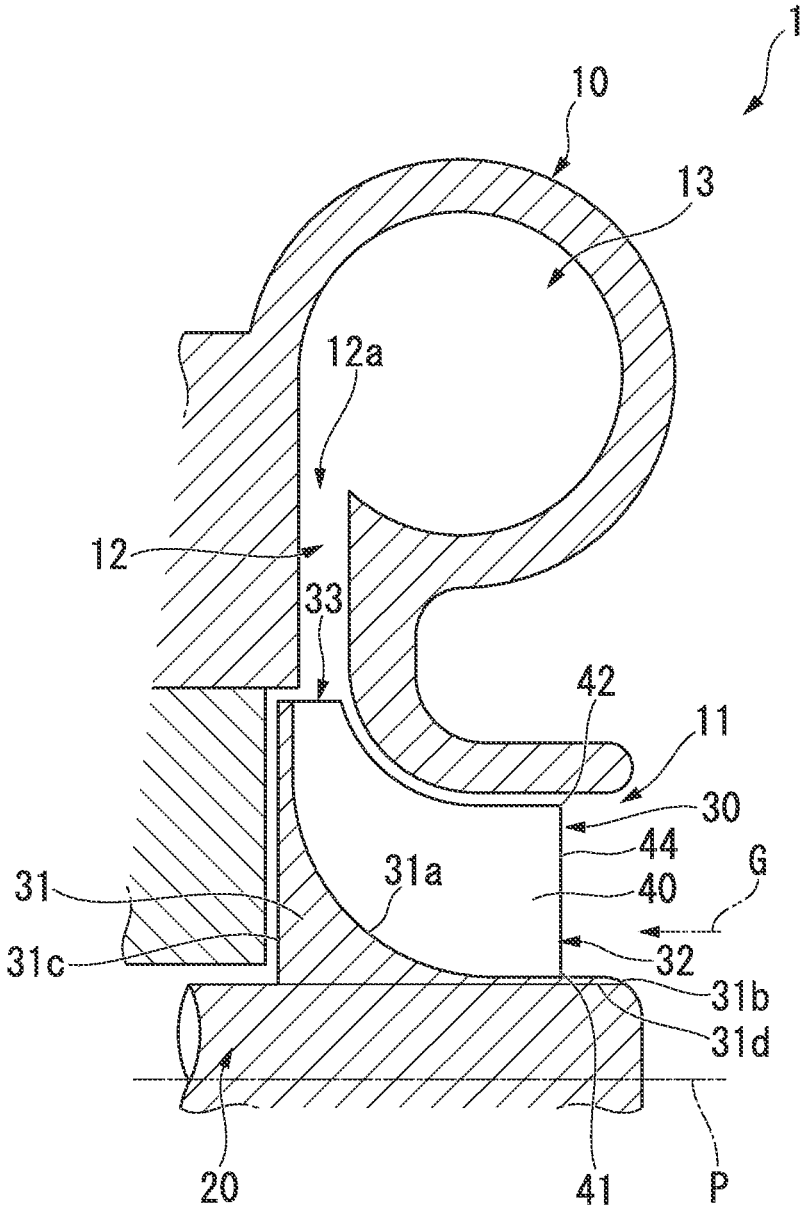
FIG. 1 is an enlarged cross sectional view of a main component of a centrifugal compressor 1 according to a first embodiment of the present invention.

First, a first embodiment of the present invention is described. FIG. 1 is an enlarged cross sectional view of a main component of a centrifugal compressor 1 according to a first embodiment of the present invention.

First, a general configuration of the centrifugal compressor 1 is described. As shown in FIG. 1, the centrifugal compressor 1 includes a volute casing 10, a main axis 20, and an impeller 30.

The volute casing 10 includes a casing main body part 11, a diffuser part 12, and a volute part 13. The casing main body part 11 has a storage space of an impeller 30. The diffuser part 12 enlarges a passage from a lower stream side of the casing main body part 11 in a radial direction. The volute part 13 is configured to be in a volute form and connects with an outer radius part 12*a* of the diffuser part 12.

The main axis 20 is inserted in the casing main body part 11. The main axis 20 is rotated and driven from outside with the rotating central axis P being a center.

Figure 2:
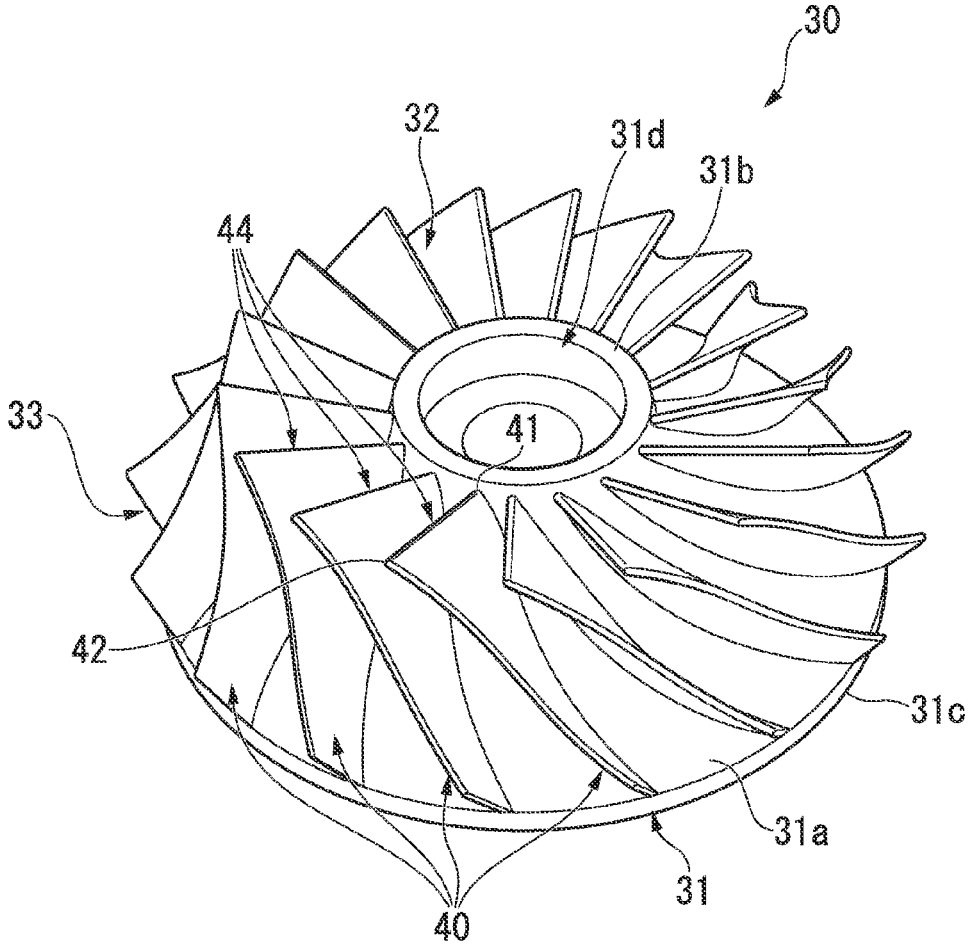
FIG. 2 is an external perspective view of a configuration of an impeller 30 according to the above embodiment of the present invention.

FIG. 2 is an external perspective view of a configuration of an impeller 30. The impeller 30 is formed as a disk-like shape. The impeller 30 includes a hub 31 and a plurality of blades 40. The outer radius of the hub 31 gradually increases from the upper stream side of the axial direction towards the lower stream side. As shown in FIG. 2, the plurality of blades 40 are in three dimensional form.

As shown in FIG. 1, the hub 31 has an outer circumferential curved surface 31*a*. The contour of the cross section of the outer circumferential curved surface is parabolic. This hub 31 has a penetration hole 31*d* which opens at an upper stream end surface 31*b* and a lower stream end surface 31*c*. The main axis 20 is inserted and fixed to this penetration hole 31*d*.

The blade 40 protrudes from the outer circumferential curved surface 31*a*. A plurality of the blades 40 are provided in a radial fashion. This blade 40 is described later.

According to the impeller 30 configured in this way, a radially inner circumferential side at an upper stream end surface 31*b* side is referred to as a fluid inflow part 32. An outer circumferential part at a lower stream end surface 31*c* side is referred to as a fluid outflow part 33.

According to such a configuration, when a gas G, flowing in an axial direction along the main axis 20 in the casing main body part 11, flows from the fluid inflow part 32 to the impeller 30 as shown in FIG. 1, the gas G flows through a passage partitioned by the outer circumferential curved surface 31*a*, each blade 40, and the casing main body part 11. As this gas G proceeds toward the lower stream side, the direction of the flow gradually faces the radial direction. Further, the gas G flows out from the fluid outflow part 33 toward an external direction in the radial direction. Thereafter, the gas G flows into the volute part 13 via the diffuser part 12.

Figure 3:
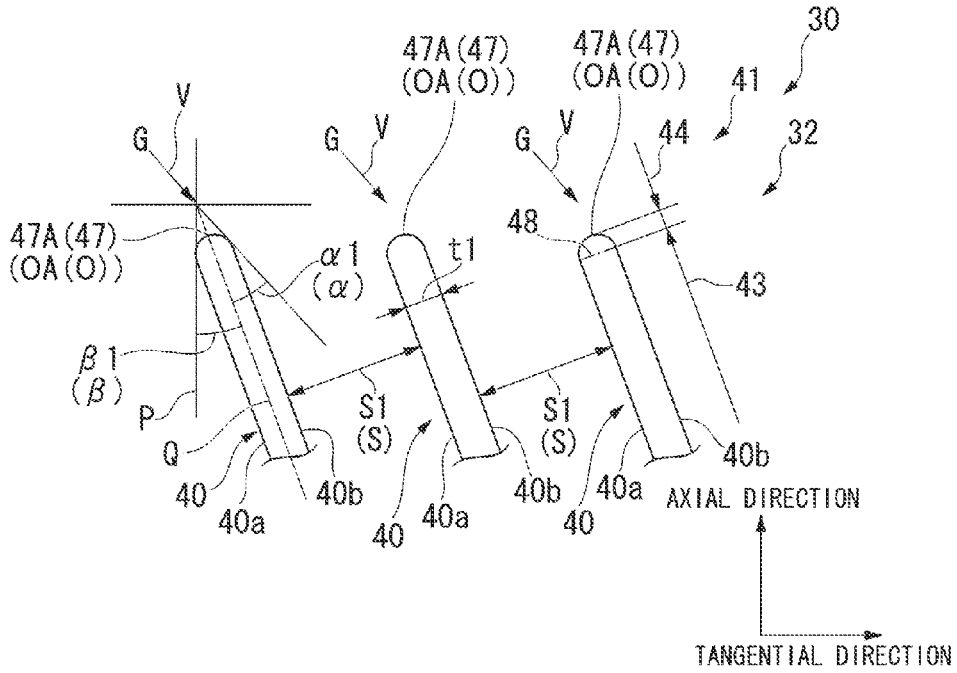
FIG. 3 is diagram showing an impeller 30 according to the above embodiment of the present invention developed in a tangential direction. This
Figure 4:
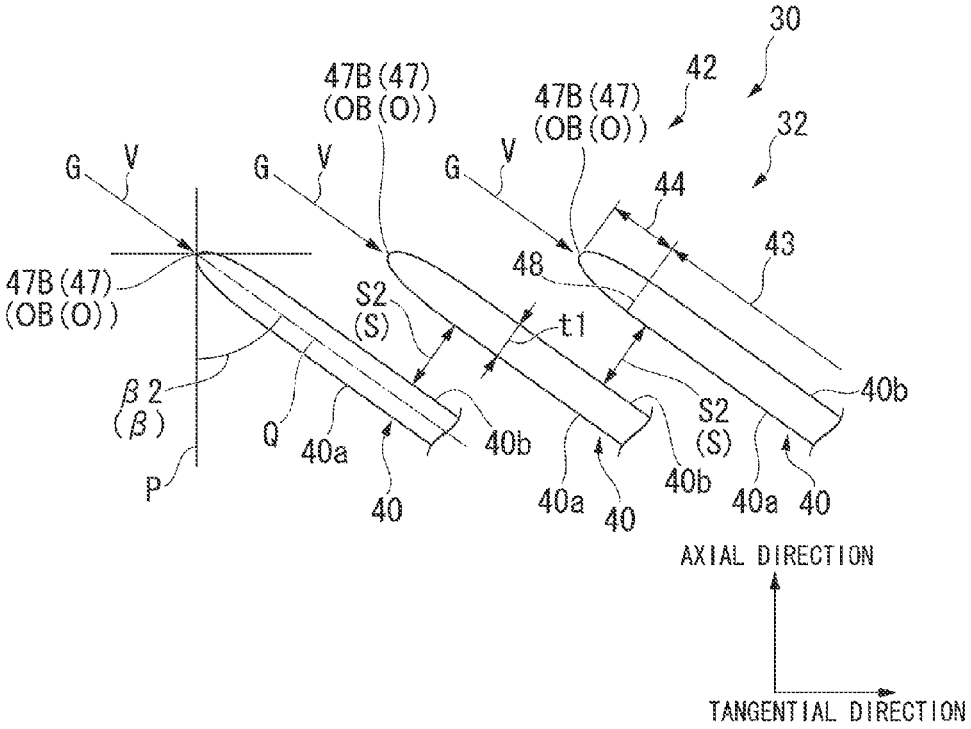
FIG. 4 is a diagram showing an impeller according to the above embodiment of the present invention developed in a tangential direction. This

FIG. 3 and FIG. 4 are diagrams showing the impeller 30 developed in a tangential direction. FIG. 3 shows the fluid inflow part 32 at an inner end 41 (hub side) in the radial direction. FIG. 4 shows the fluid inflow part 32 at an outer end 42 (tip side) in the radial direction.

As shown in FIG. 3 and FIG. 4, the blade 40 is formed with a certain blade thickness (component thickness) t1. This blade 40 has a main body part 43 and a leading edge 44. The main body part 43 has a pressure side 40*a* and a suction side 40*b*. The pressure received by the pressure side 40*a* from the gas G is relatively high. The pressure received by the suction side 40*b* from the gas G is relatively low. Further, the leading edge 44 connects the pressure side 40*a* and the suction side 40*b* at the fluid inflow part 32 (see FIG. 1) in the form of a curved surface.

As shown in FIG. 3, according to the blade 40, the angle $\beta$ is an angle between the component central line Q of the main body part 43 and the center axis of rotation P (axial direction). At the inner end 41, the angle is $\beta 1$. Further, as shown in FIG. 4, the angle $\beta$ at the outer end 42 as $\beta 2$ ($>\beta 1$). The angle $\beta$ between the component central line Q and the center axis of rotation P gradually becomes larger at a certain rate of change from the inner end 41 toward the outer end 42.

In other words, the incidence angle $\alpha$ between the direction of the relative inflow velocity v of the gas G, flowing in from an axial direction with respect to the rotating blade 40, and the component central line Q is $\alpha 1$ at an inner end 41 in the radial direction, as shown in FIG. 3. Further, the incidence angle $\alpha$ is $\alpha 2$ (=0) at an outer end 42 in the radial direction. Between the inner end 41 and the outer end 42, the incidence angle $\alpha$ becomes gradually smaller at a certain rate of change from the inner end 41 in the radial direction toward an outer end 42.

As shown in FIG. 3 and FIG. 4, the throat area S between blades 40 corresponds to the magnitude of the incidence angle $\alpha$. In other words, the throat area S1, at the inner end 41 at which the incidence angle is $\alpha 1$, is larger than the throat area S2, at the outer end 42 at which the incidence angle is $\alpha 2$ (=0). Thus, the throat area gradually becomes smaller from the inner end 41 in the radial direction toward the outer end 42 with a constant rate of change.

As shown in FIG. 3, the cross section of the leading edge 44 at the inner end 41 is shaped as a half circle. A tip 47A of the leading edge corresponds to a central position OA which is an intersection between an extended line of the component central line Q and the contour line of the leading edge 44. In further detail, the leading edge 44 is connected to the main body part 43 after drawing a contour of a quarter arc form with the same radius of curvature $\rho 1$ towards the lower stream sides of a pressure side 40*a* side and a suction side 40*b* side, with the central position OA being the starting point. In other words, the radius of curvature $\rho 1$ of this tip 47A of the leading edge is set to be half of the blade thickness t1 of the connection part 48 between the main body part 43 and the leading edge 44.

As shown in FIG. 4, the shape of the cross section of the leading edge 44 at the outer end 42 is an oval. The tip 47B of the leading edge corresponds to the central position OB which is an intersection between the extended line of the component central line Q and the contour of the leading edge 44. In particular, the shape of the cross section of the leading edge 44 corresponds to half of an oval having a length of the minor axis equal to the blade thickness t1 of the connection part 48. This shape is obtained by cutting the oval with the minor axis. As shown in FIG. 4, the pressure side 40*a* and the suction side 40*b* are connected via the leading edge 44.

In this way, the radius of curvature at the tip 47B of the leading edge is ρ2 (<ρ1). The leading edge 44 at the outer end 42 is configured so that this ρ2 is less than half of the blade thickness t1.

Figure 5:
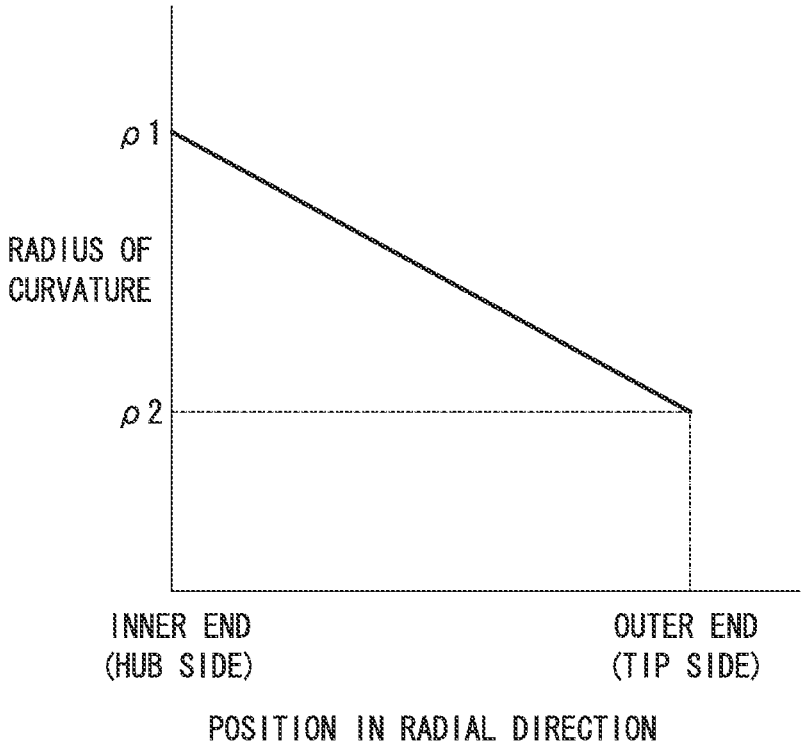
FIG. 5 is a graph showing a relationship between a position of a leading edge tip 47 in a radial direction (horizontal axis) and a radius of curvature (vertical axis) according to the above embodiment of the present invention.

FIG. 5 is a graph showing a relationship between the position of a leading edge tip 47 in a radial direction (horizontal axis) and the radius of curvature (vertical axis). As shown in FIG. 5, the radius of curvature p of the leading edge tip 47 decreases at a constant rate of change from the inner end 41 toward the outer end 42. Incidentally, the rate of change of the incidence angle α from the inner end 41 toward the outer end 42 decreases at a constant the rate of change of the radius of curvature ρ.

Next, a working of the centrifugal compressor 1 is described. First, when a rotational driving force is applied from outside to the main axis 20, the main axis 20 and the impeller 3 integrated with the main axis 20 rotate (see FIG. 1). Further, the number of rotation of the impeller 30 reaches a predetermined number of rotation.

Gas G flows into the impeller 30 from the fluid inflow part 32 in an axial direction. While the gas G flows through the impeller 30, pressure energy and velocity energy are provided to the gas G. Then, the gas G flows out from the fluid outflow part 33 in an outer radial direction. Further, while the gas G flows through the diffuser part 12 and the volute part 13, velocity energy is converted to pressure energy.

Among these flow processes, when the gas G flows into the impeller 30, the energy loss becomes extremely small.

In other words, as shown in FIG. 4, at an outer end 42 side of the leading edge 44, at which the flow velocity is high and an influence on efficiency is relatively large, the radius of curvature ρ2 of the leading edge tip 47B (central position OB) is relatively small. This radius of curvature ρ2 is less than half of the blade thickness t1. Therefore, the shock loss of the gas G and the leading edge tip 47B becomes small. Meanwhile, when the radius of curvature ρ of the leading edge tip 47 is reduced, the gas G is separated more easily in general. However, the incidence angle α at the outer end 42 side is equal to α2 (=0) which is smaller than the incidence angle α1 at the inner end 41 side. As a result, even when the gas G flows towards the suction side 40*b* side, a separation seldom occurs.

Meanwhile, at an inner end 41 side of the leading edge 44, at which the flow velocity is small and the influence on efficiency is relatively small, the incidence angle α1 is set to be relatively large. Further, the throat area S1 is large. As a result, a relatively large amount of gas G flows through. Furthermore, since the radius of curvature of the leading edge tip 47A (central position OA) is a relatively large radius of curvature ρ1, a separation seldom occurs even if the gas G flows toward the suction side 40*b* side.

Further, the radius of curvature ρ of the leading edge tip 47 decreases from the inner end 41 toward the outer end 42 at a constant rate of change. Therefore, the shock loss of the gas G is smaller from the inner end 41 toward the outer end 42. In other words, from an inner end 41 of the leading edge 44 toward the outer end 42, the energy loss due to the gas G colliding with the leading edge tip 47 becomes small. Further, from the inner end 41 toward the outer end 42, the incidence angle α decreases at a constant rate of change. Therefore, a separation of flow seldom occurs from the inner end 41 toward the outer end 42.

In this way, the gas G flows inside the impeller 30 while causing little energy loss. As a result, the pressure energy is heightened.

As described above, according to the centrifugal compressor 1, a configuration is made so that an angle β between the component central line Q and the central axis P of rotation becomes large from the inner end 41 toward the outer end 42. In other words, a configuration is made so that the incidence angle α between the component central line Q and the direction of the relative inflow velocity v decreases from the inner end 41 toward the outer end 42. As a result, at the outer end 42 side at which the flow velocity of gas G is large, it is possible to reduce the incidence angle α (i.e., increase the angle β(β2)), thereby preventing a separation of flow and enhancing the efficiency. Furthermore, the radius of curvature ρ at the central position O of the leading edge 44 is set to become smaller from the inner end 41 to the outer end 42. As a result, at the outer end 42 side, at which the flow velocity is large, it is possible to reduce the shock loss of the gas G at the leading edge 44 relative to the inner end 41 side, at which the flow velocity is small. As a result, in general, it is possible to prevent a decline in efficiency due to shock loss. Moreover, it is possible to further enhance the efficiency. Meanwhile, at the inner end 41 side having a low flow velocity, the incidence angle α is set to be larger (i.e. the angle β(β1) is set to be smaller) compared to the outer end 42 side. Further, the throat area S (S1) is larger. As a result, it is possible to retain a choke flow amount. At the same time, even if the incidence angle α is large, the flow may be prevented from separating by increasing the radius of curvature. Consequently, in general, the flow amount may be maintained while the efficiency may be enhanced.

In other words, the radius of curvature ρ of the leading edge tip 47 gradually becomes smaller from the inner end 41 side to the outer end 42 side. As a result, the radius of curvature ρ of the leading edge tip 47 becomes smaller at the outer end 42 side, at which the incidence angle α is relatively small and the flow is less likely to separate. Therefore, it is possible to greatly reduce the shock loss at the outer end 42 side at which a separation is less likely to occur. Further, at a wide range in the radial direction, the shock loss may be reduced. At the same time, the likelihood of a separation occurring is not increased. Therefore, the shock loss is greatly reduced, while a high degree of efficiency is obtained. Hence, a highly efficient centrifugal compressor 1 may be provided.

Incidentally, the radius of curvature ρ becomes smaller from the inner end 41 toward the outer end 42 at a constant rate of change. As a result, it becomes easier to define the shape of the leading edge 44. Consequently, it becomes easier to create a processing program or process a machine.

Figure 6:
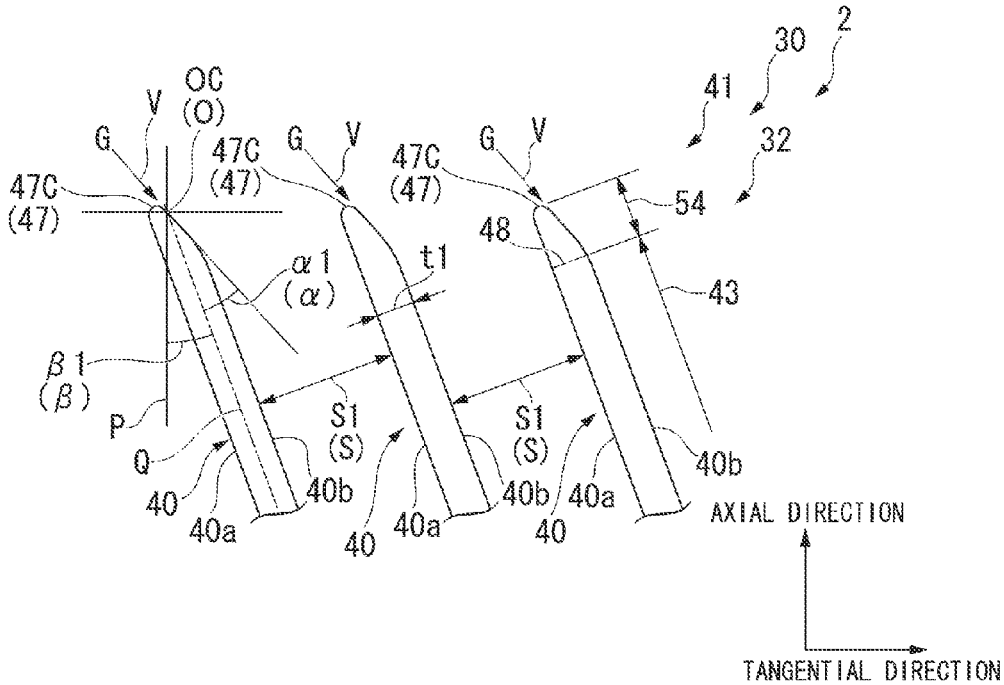
FIG. 6 is a diagram showing an impeller 30 of a centrifugal compressor 2 according to a second embodiment of the present invention developed in a tangential direction. This
Figure 7:
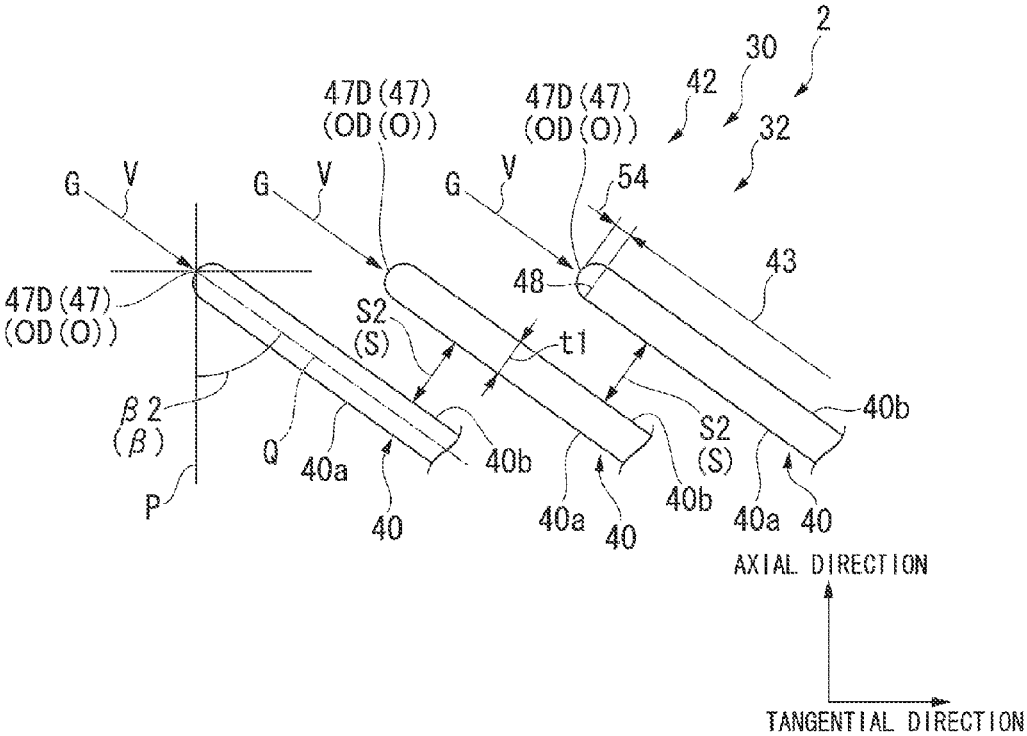
FIG. 7 is a diagram showing an impeller 30 of a centrifugal compressor 2 according to a second embodiment of the present invention developed in a tangential direction. This

Next, a second embodiment of the present invention is described. FIG. 6 and FIG. 7 are diagrams showing an impeller 30 of a centrifugal compressor 2 according to the second embodiment of the present invention developed in a tangential direction. FIG. 6 shows a fluid inflow part 32 at an inner end 41 (hub side) in a radial direction. FIG. 7 shows a fluid inflow part 32 at an outer end 42 (tip side) in a radial direction. Incidentally, in FIG. 6 and FIG. 7, the same reference numerals used in FIGS. 1 to 5 are used to refer to similar components. Descriptions of similar components are omitted.

According to the centrifugal compressor 2, the shape of the leading edge 54 of the blade 40 is different from the leading edge 44 described above. Similar to the first embodiment, between the inner end 41 and the outer end 42, the incidence angle α gradually becomes smaller at a constant rate of change from the inner end 41 in the radial direction toward the outer end 42.

As shown in FIG. 6, the leading edge 54 at the inner end 41 is configured so that the leading edge tip 47C is formed toward the pressure side 40*a* side compared to the central position OC which is an intersection between an extended line of the component central line Q and the contour of the leading edge 54. The shape of the cross section of the leading edge 54 is asymmetrical so that the radius of curvature at the pressure side 40*a* side compared to the leading edge tip 47C is ρ3, and the radius of curvature at the suction side 40*b* side compared to the leading edge tip 47C is ρ4. In more detail, the radius of curvature ρ3 at the pressure side 40*a* side compared to the leading edge tip 47C is set to be less than half of the blade thickness t1 of the connection part 48. In addition, the radius of curvature ρ4 at the suction side 40*b* side is set to greater than half of the blade thickness t1 of the main body part 43. In addition, the leading edge tip 47C is set to the radius of curvature ρ2 (<ρ1).

As shown in FIG. 7, the shape of the cross section of the leading edge 54 of the outer end 42 is a half circle. The leading edge tip 47D corresponds to the central position OD, which is an intersection between the extended line of the component central line Q and the contour of the leading edge 54. The radius of curvature ρ1 at the central position OD is set to be (half of the blade thickness t1 of the main body part 43 at the connection part 48).

Such a radius of curvature ρ of the leading edge 54 is configured so that the rate of change is constant from the inner end 41 toward the outer end 42. In other words, the radius of curvature ρ of the leading edge tip 47 increases from the radius of curvature ρ2 to the radius of curvature ρ1 at a constant rate of change from the inner end 41 toward the outer end 42. In addition, the radius of curvature ρ at a pressure side 40*a* side compared to the leading edge tip 47C increases from the radius of curvature ρ3 to the radius of curvature ρ1 at a constant rate of change from the inner end 41 toward the outer end 42. In addition, the radius of curvature ρ at a suction side 40*b* side compared to the leading edge tip 47C decreases from the radius of curvature ρ4 to the radius of curvature ρ1 at a constant rate of change from the inner end 41 toward the outer end 42.

According to such a configuration, at an inner end 41 side having a small flow velocity, the pressure side 40*a* side is configured so that the radius of curvature ρ3 is set to be less than half of the blade thickness t1. Further, the leading edge tip 47C is configured so that the radius of curvature ρ2 is set to be less than half of the blade thickness t1. As a result, it is possible to prevent the shock loss at the inner end 41 side.

Further, the suction side 40*b* side is configured so that the radius of curvature ρ4 is greater than half of the blade thickness t1. Therefore, it is possible to prevent a loss due to the separation of gas G flowing toward the suction side 40*b* along the leading edge 54. As a result, a high degree of efficiency may be achieved. In particular, when the leading edge tip 47C is formed to have a relatively small radius of curvature ρ2 in a condition in which the incidence angle α(α1) is set to be relatively large like the inner end 41, a separation normally becomes more likely to occur. However, according to the present embodiment, the suction side 40*b* side of the leading edge tip 47C is formed to have a relatively large radius of curvature ρ4. Therefore, the gas G flowing toward the suction side 40*b* along the leading edge tip 47 is prevented from separating. As a result, it is possible to prevent a loss due to the separation of the gas G.

In this way, at the inner end 41 side, it is possible to prevent a shock loss while preventing a separation. As a result, it is possible to achieve a high degree of efficiency.

Further, the radius of curvature ρ2 of the leading edge tip 47 and the radius of curvature ρ3 at the pressure side 40*a* side gradually increases to ρ1 from the inner end 41 toward the outer end 42. At the same time, the radius of curvature ρ4 at the suction side 40*b* side gradually decreases to ρ2. Therefore, at a wide range of the leading edge 54 in a radial direction, it is possible to prevent a shock loss while, at the same time, preventing a separation. As a result, a high degree of efficiency may be achieved.

Figure 8:
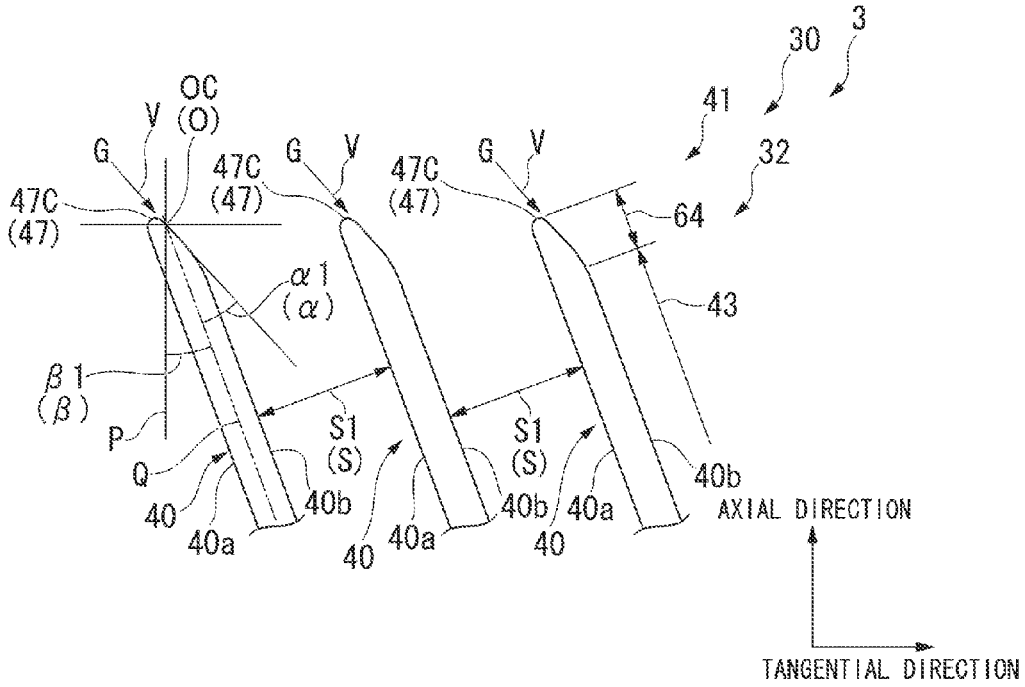
FIG. 8 is a diagram showing an impeller 30 of a centrifugal compressor 3 according to a third embodiment of the present invention developed in a tangential direction. This
Figure 9:
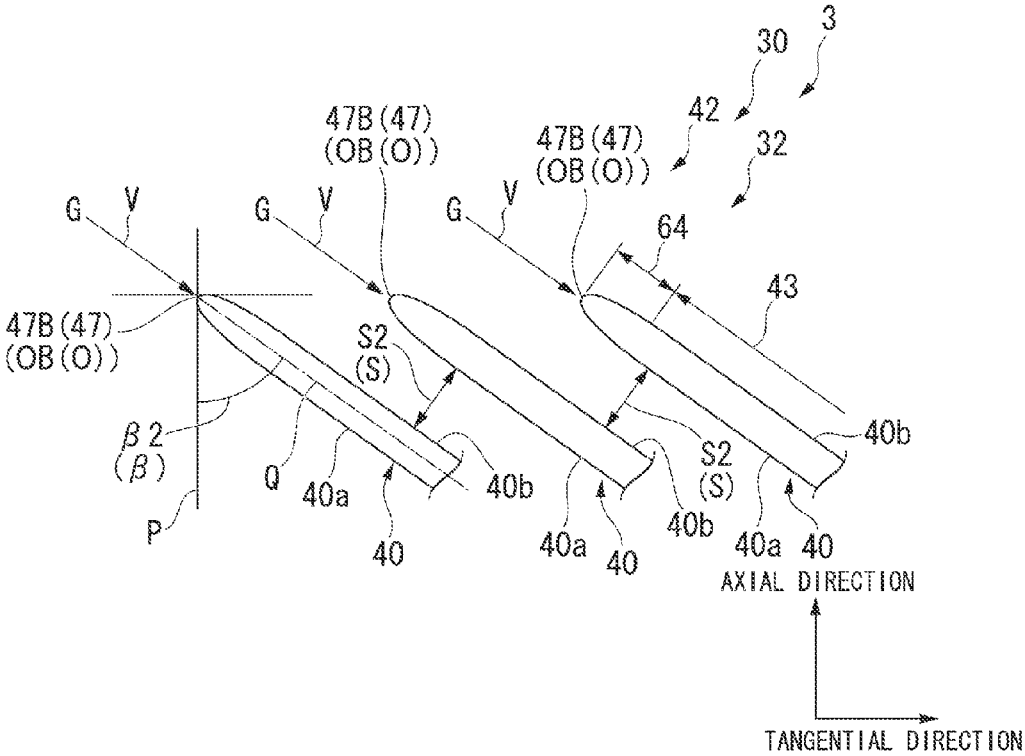
FIG. 9 is a diagram showing an impeller 30 of a centrifugal compressor 3 according to a third embodiment of the present invention developed in a tangential direction. This

Next, a third embodiment of the present invention is described. FIG. 8 and FIG. 9 are diagrams showing an impeller 30 of a centrifugal compressor 3 according to the third embodiment of the present invention developed in a tangential direction. FIG. 8 shows a fluid inflow part 32 at an inner end 41 (hub side) in a radial direction. FIG. 9 shows a fluid inflow part 32 at an outer end 42 (tip side) in a radial direction. Incidentally, in FIG. 8 and FIG. 9, the same reference numerals used in FIGS. 1 to 7 are used to refer to similar components. Descriptions of similar components are omitted.

The centrifugal compressor 3 includes a leading edge 64 instead of the leading edge 44 described in the first embodiment and instead of the leading edge 54 described in the second embodiment. Similar to the first embodiment, between the inner end 41 and the outer end 42, the incidence angle α gradually becomes smaller at a constant rate of change from the inner end 41 in the radial direction toward the outer end 42.

As shown in FIG. 8, the shape of the cross section of the leading edge 64 of the inner end 41 is similar to that of the leading edge 54 according to the second embodiment. The shape is asymmetrical, since the leading edge tip 47C is formed toward the pressure side 40*a* side compared to the central position OC. In other words, the radius of curvature ρ3 at a pressure side 40*a* side compared to the leading edge tip 47C is set to be less than half of the blade thickness t1 of the connection part 48. In addition, the radius of curvature ρ4 at a suction side 40*b* side is set to be greater than half of the blade thickness t1 of the main body part 43. In addition, the radius of curvature of the leading edge tip 47C is set to be equal to ρ2.

As shown in FIG. 9, the shape of the cross section of the leading edge 64 of the outer end 42 is an oval, similar to the outer end 42 of the leading edge 44 according to the first embodiment described above. In other words, the leading edge tip 47B corresponds to the central position OB. In addition, the leading edge 64 of the outer end 42 is configured so that the leading edge tip 47B has a radius of curvature equal to ρ2.

The radius of curvature ρ of the leading edge 64 described above changes at a constant rate of change from the inner end 41 toward the outer end 42. In other words, compared to the leading edge tip 47C, the radius of curvature ρ at a pressure side 40*a* side increases at a constant rate of change from the inner end 41 toward the outer end 42. In addition, the radius of curvature ρ at a suction side 40*b* side compared to the leading edge tip 47C decreases at a constant rate of change from the inner end 41 toward the outer end 42.

Furthermore, the radius of curvature of the leading edge tip 47C (ρ2) is equal to the radius of curvature of the leading edge tip 47B (ρ2). All of the leading edge tips 47 of the leading edge 64 in the radial direction are configured so that the radius of curvature equals ρ2.

According to such a configuration, all of the leading edge tips 47 of the leading edge 64 in the radial direction are configured so that the radius of curvature equals ρ2. Therefore, it is possible to reduce the shock loss over the entirety of the radial direction.

Further, at the outer end 42 side, the incidence angle α is configured to be small (α2=0). Therefore, a separation of a flow is less likely to occur. Meanwhile, at the inner end 41 side, the incidence angle α1 is configured to be large (α1(>α2)). Therefore, in general, a separation of a flow is more likely to occur. However, the suction side 40*b* side compared to the leading edge tip 47C is formed to have a relatively large radius of curvature ρ4. Therefore, even if the incidence angle α1 is large, it is possible to effectively prevent the gas G from separating.

According to the configuration described above, it is possible to prevent a shock loss while, at the same time, preventing a separation throughout the entirety of the radial direction from the inner end 41 of the leading edge 64 toward the outer end 42. Therefore, it is possible to achieve an extremely high degree of efficiency. In this way, a highly efficient centrifugal compressor 3 may be provided.

Incidentally, the order of operation described in the above embodiments, various shapes of each component, and combinations are only examples. Various alterations may be made according to configuration needs as long as the gist of the present invention is not deviated.

For example, according to the embodiment described above, the rate of change of the radius of curvature ρ of the leading edge 44, 54, and 64 was constant from the inner end 41 toward the outer end 42. However, it is not necessary that the rate of change be constant.

Figure 10:
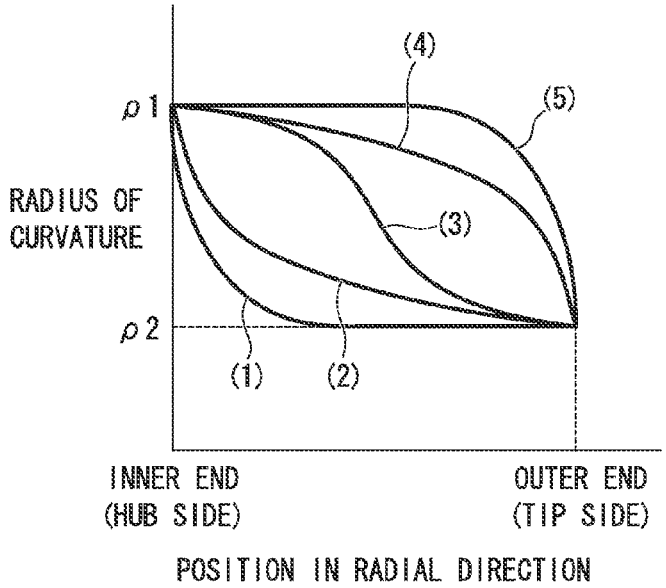
FIG. 10 is a diagram showing a first variation of a leading edge of a centrifugal compressor according to the first to third embodiments of the present invention. This

For example, as shown in FIG. 10, similar to the first embodiment, when the shape of the cross section of the leading edge 44 is configured to be a half circle at the inner end 41, and when the shape is configured to be an oval at the outer end 42, as shown in graph (1), from the inner end 41 toward the outer end 42, the radius of curvature ρ of the leading edge tip 47A at the inner end 41 side may be reduced suddenly, then, may be reduced gradually. According to such a configuration, the leading edge tip 47 is formed so that the radius of curvature ρ is small over a wide range. Therefore, compared to a case in which the rate of change of the radius of curvature ρ is constant, it is possible to reduce the shock loss at a wider range. Incidentally, the radius of curvature ρ may be changed as shown in graphs (2) to (5). According to such a configuration, it is possible to select the most appropriate shape according to the conditions of using the centrifugal compressor, the functionalities of the centrifugal compressor, the manufacturing cost, and the like. Incidentally, by adjusting the mass of the blade 40, it is possible to adjust the centrifugal force applied to the blade and to adjust the eigenfrequency.

Figure 11:
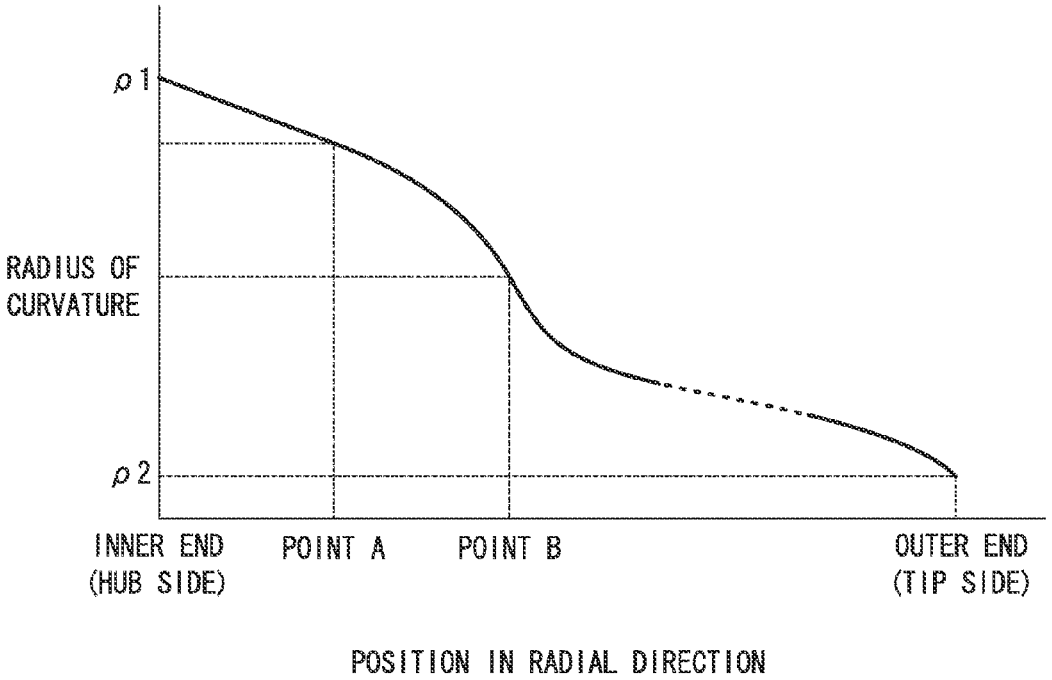
FIG. 11 is a diagram showing a second variation of a leading edge of a centrifugal compressor according to the first to third embodiments of the present invention. This

Similarly, as shown in FIG. 11, it is possible to partition the length in the radial direction into a plurality of predetermined ranges. The rate of change may be altered for each predetermined range. For example, the rate of change of the radius of curvature ρ may be made constant at a range from the inner end 41 to point A, while the rate of change of the radius of curvature ρ from point A to point B may be increased toward point B. In this way, a most suitable shape may be achieved.

Further, it is possible to alter the rate of change of the radius of curvature ρ at the pressure side 40*a* side or the suction side 40*b* side of the leading edge 54, 64 according to the second embodiment and the third embodiment as well as that of the leading edge tip 47 according to the first embodiment.

Incidentally, the rate of change of the angle β between the component central line Q and the central axis of rotation P, the incidence angle α, or the throat area S need not be constant as well from the inner 41 toward the outer end 42.

In addition, the contour of the leading edge 44, 54, and 64 need not have a single radius of curvature ρ, nor have a combination of less than or equal to three radii of curvature. Four or more radii of curvature may be combined to be continuous in a smooth manner.

Incidentally, the shape of the cross section at the outer end 42 side of the leading edge 44, 64 according to the first embodiment and the third embodiment were configured to be an oval. However, the present invention is not limited to this configuration. At least one or more radius of curvature greater than the radius of curvature of the leading edge tip 47 may be provided at the pressure side 40*a* side or the suction side 40*b* side. Thus, the shape may be configured so that the radius of curvature of the leading edge tip 47 is connected smoothly with the main body part 43.

By the way, the incidence angle α2 at the outer end 42 side need not be equal to 0 (zero) as long as the incidence angle α2 is less than the incidence angle α1 at the inner end 41 side.

Furthermore, according to the embodiments described above, the present invention was applied to an impeller 30 which is a so-called open impeller. According to an open impeller, a shroud (outer tube) is not provided at an outer circumferential of the blade 40. However, the present invention may be applied to a so-called closed impeller. According to a closed impeller, a shroud is provided at an outer circumferential of the blade 40.

Further, according to the embodiments described above, an example was described in which the present invention was applied to a centrifugal compressor configured as a single layer. However, the present invention may be applied to a centrifugal compressor configured as a plurality of layers.

INDUSTRIAL APPLICABILITY

According to a centrifugal compressor based on the present invention, it is possible to provide a centrifugal compressor having a high degree of efficiency.

DESCRIPTION OF REFERENCE NUMERALS

1-3 Centrifugal Compressor
30 Impeller
31 Hub
40 Blade
40*a* Pressure side
40*b* Suction side
41 Inner End
42 Outer End
43 Main Body Part
44, 54, 64 Leading edge
47 (47A-47D) Leading edge Tip
48 Connection Part
G Gas (Fluid)
O (OA-OD) Central Position
P Central Axis Of Rotation
Q Component Central Line
S (S1, S2) Throat Area
t1 Blade Thickness (Component Thickness)
v Relative Inflow Velocity

The invention claimed is:

1. An impeller of a centrifugal compressor, the impeller comprising:

a hub shaped like a disk;

a plurality of blades protruding from a surface of the hub and provided radially, wherein a passage is formed by the hub and a blade being adjacent with the hub, so that a fluid, flowing in along an axial direction at an inner circumferential side in a radial direction, is flowed out toward an outer circumferential side in a radial direction;

each of the plurality of blades comprises a main body part and a leading edge, the main body part comprising a pressure side and a suction side, the pressure side receiving a pressure from a fluid flowing through the passage which is relatively high, the suction side receiving a pressure from a fluid flowing through the passage which is relatively low, and the leading edge being shaped as a curved surface connecting the pressure side and the suction side at the inner circumferential side in the radial direction;

an angle between a component central line of the main body part and the axial direction increases from an inner end toward an outer end, the inner end connecting with the hub; and a radius of curvature of the leading edge at a central position, intersecting with the component central line of the main body part, decreases from the inner end toward the outer end.

2. The impeller of the centrifugal compressor according to claim 1, wherein a radius of curvature at the central position toward the outer end of the leading edge is less than half of a component thickness of the main body part at a position connecting with the leading edge.

3. The impeller of the centrifugal compressor according to claim 1, wherein a radius of curvature, toward the inner end of the leading edge, is less than half of a component thickness of the main body part at a position connecting with the leading edge toward the pressure side compared to the central position, and is greater than half of the component thickness toward the suction side.

4. The impeller of the centrifugal compressor according to claim 1, wherein a rate of change of a radius of curvature of the leading edge is constant from the inner end toward the outer end.

5. The impeller of the centrifugal compressor according to claim 1, wherein a rate of change of a radius of curvature of the leading edge varies from the inner end toward the outer end.

6. An impeller of a centrifugal compressor, the impeller comprising:

a hub shaped like a disk;

a plurality of blades protruding from a surface of the hub and provided radially, wherein a passage is formed by the hub and a blade being adjacent with the hub, so that a fluid, flowing in along an axial direction at an inner circumferential side in a radial direction, is flowed out toward an outer circumferential side in a radial direction;

each of the plurality of blades comprises a main body part and a leading edge, the main body part comprising a pressure side and a suction side, the pressure side receiving a pressure from a fluid flowing through the passage which is relatively high, the suction side receiving a pressure from a fluid flowing through the passage which is relatively low, and the leading edge being shaped as a curved surface connecting the pressure side and the suction side at the inner circumferential side in the radial direction;

an angle between a component central line of the main body part and the axial direction increases from an inner end toward an outer end, the inner end connecting with the hub;

a shape of a cross section of the leading edge toward the outer end is an oval; and a radius of curvature of a tip of the leading edge decreases from the inner end toward the outer end.

7. An impeller of a centrifugal compressor, the impeller comprising:

a hub shaped like a disk;

a plurality of blades protruding from a surface of the hub and provided radially, wherein a passage is formed by the hub and a blade being adjacent with the hub, so that a fluid, flowing in along an axial direction at an inner circumferential side in a radial direction, is flowed out toward an outer circumferential side in a radial direction;

each of the plurality of blades comprises a main body part and a leading edge, the main body part comprising a pressure side and a suction side, the pressure side receiving a pressure from a fluid flowing through the passage which is relatively high, the suction side receiving a pressure from a fluid flowing through the passage which is relatively low, and the leading edge being shaped as a curved surface connecting the pressure side and the suction side at the inner circumferential side in the radial direction;

an angle between a component central line of the main body part and the axial direction increases from an inner end toward an outer end, the inner end connecting with the hub;

a shape of a cross section toward the inner end of the leading edge is asymmetrical, wherein a radius of curvature toward the pressure side compared to a tip of the leading edge is smaller than a radius of curvature toward the suction side compared to the tip of the leading edge; and a radius of curvature toward the pressure side increases from the inner end toward the outer end while a radius of curvature toward the suction side decreases.

* * * * *